US009796556B1

(12) United States Patent
Hill et al.

(10) Patent No.: US 9,796,556 B1
(45) Date of Patent: Oct. 24, 2017

(54) CABLE DISPENSER

(71) Applicant: TIME SAVER PRODUCTS, INC., Brook Park, OH (US)

(72) Inventors: Douglas C. Hill, Brook Park, OH (US); Ronald James Hill, Parma, OH (US)

(73) Assignee: Time Saver Products, Inc., Brook Park, OH (US)

( * ) Notice: Subject to any disclaimer, the term of this patent is extended or adjusted under 35 U.S.C. 154(b) by 371 days.

(21) Appl. No.: 14/100,201

(22) Filed: Dec. 9, 2013

Related U.S. Application Data

(60) Provisional application No. 61/735,377, filed on Dec. 10, 2012.

(51) Int. Cl.
*B65H 49/32* (2006.01)

(52) U.S. Cl.
CPC ..... *B65H 49/322* (2013.01); *B65H 49/32* (2013.01)

(58) Field of Classification Search
CPC ..... B65H 49/30; B65H 49/28; B65H 49/305; B65H 49/322
USPC ..... 242/129
See application file for complete search history.

(56) References Cited

U.S. PATENT DOCUMENTS 1,102,128 A * 6/1914 Bastian ..... B65H 49/28 242/597.7
2,491,585 A * 12/1949 Sammons ..... A47F 13/04 242/130
2,554,615 A * 5/1951 Dahle ..... B65D 85/04 242/146
2,562,650 A * 7/1951 Trunkhill ..... B65H 49/30 242/129
2,965,331 A * 12/1960 Nagy ..... A47F 13/04 242/138
3,464,647 A * 9/1969 Jacobi ..... B65H 49/28 242/129
3,780,964 A * 12/1973 Gonzalez ..... B21C 47/16 206/403
4,089,486 A * 5/1978 Carter ..... B65H 49/28 242/129

(Continued)

OTHER PUBLICATIONS

Hill, Douglas C.; U.S. Appl. No. 12/572,283 for "CLIP"; filed Oct. 2, 2009, now abandoned.

(Continued)

*Primary Examiner* — Emmanuel M Marcelo
*Assistant Examiner* — Michael Gallion
(74) *Attorney, Agent, or Firm* — Rankin, Hill & Clark LLP

(57) ABSTRACT

A cable dispensing system for unwinding a spool of cable not having a central core, the system comprising a tub having a base and a side wall with a side wall opening partially forming an inner space sized to fit the spool, the system further including an inner assembly having a base plate and a bearing assembly between the plate and the tub base, the bearing assembly supporting both the axial load and providing free rotation of the plate relative to the tub base about an inner space axis and unrestricted rotation of the associated spool about the system axis, the opening in the side wall allowing passage of the associated cable out of the inner space wherein pulling the cable out of the inner space rotates the associated spool about the inner space axis and unwinds the cable from the spool with low resistance and without kinking.

23 Claims, 9 Drawing Sheets

(56) References Cited

U.S. PATENT DOCUMENTS 4,184,647 A * 1/1980 Rourke ..... B21C 47/18 242/129.8
4,787,168 A * 11/1988 Benit ..... A01K 89/003 242/588.6
4,826,100 A * 5/1989 Belliveau ..... B65H 75/364 242/129
4,846,343 A * 7/1989 Rupert ..... B65D 85/04 206/303
4,913,369 A * 4/1990 Lia ..... B65H 75/40 242/129
4,953,810 A * 9/1990 Stadig ..... B65H 49/28 242/129
5,103,977 A * 4/1992 Douglas ..... B65H 75/364 206/388
5,139,210 A * 8/1992 Schaffer ..... B65H 49/28 242/129
5,189,719 A 2/1993 Coleman et al.
5,222,683 A * 6/1993 Blackshire ..... B65H 49/18 242/129
5,915,641 A * 6/1999 Barberg ..... B65H 75/40 191/12.2 R
6,056,226 A * 5/2000 Green ..... H02G 11/02 191/12.2 R
6,145,780 A * 11/2000 Fontana ..... B65H 49/24 242/400
6,145,781 A * 11/2000 Kawabe ..... B65D 85/04 242/132
6,486,395 B1 11/2002 Temblador
RE38,345 E 12/2003 Falciglia et al.
6,655,627 B2 * 12/2003 Patton ..... B65H 49/30 242/397.2
6,676,068 B2 * 1/2004 Emes ..... B65H 75/18 242/597.7
6,825,418 B1 11/2004 Dollins et al.
7,252,193 B1 * 8/2007 Lewis ..... B25H 3/02 206/225
7,456,361 B2 11/2008 Hill
7,608,782 B2 * 10/2009 Hill ..... H01R 4/48 174/84 C
7,694,911 B2 * 4/2010 Eggen ..... B65H 49/22 242/578
7,832,681 B2 * 11/2010 Johnson ..... B65H 49/305 242/129
8,052,078 B2 * 11/2011 DeLuca ..... B65H 49/322 242/170
8,662,300 B1 * 3/2014 Arena ..... B25H 3/00 206/372
2002/0066822 A1 * 6/2002 Emes ..... B65H 75/18 242/597.7
2003/0089818 A1 * 5/2003 Reau ..... B65H 49/28 242/588.6
2010/0193624 A1 * 8/2010 Jones ..... B65H 49/32 242/420.6
2010/0314483 A1 * 12/2010 Shah ..... B65H 49/08 242/587

OTHER PUBLICATIONS

Hill, Douglas C.; U.S. Appl. No. 60/688,954 for "CLIP"; filed Jun. 9, 2005, now expired.
Hill, Douglas C.; U.S. Appl. No. 60/759,715 for "CLIP for Flexible Amored Cable"; filed Jan. 18, 2006, now expired.

* cited by examiner

CABLE DISPENSER

The invention of this application relates to cable dispensers and, more particularly, to a new cable dispenser that can be used to unwind cable from a purchased cable spool that does not include a central core. This application claims priority to provisional patent application Ser. No. 61/735,377 filed on Dec. 10, 2012, which is incorporated by reference herein.

The dispenser of this application has been found to work well in the construction industry and for the unwinding of MC Cable; accordingly, it will be disclosed in direct relation to this industry and these cables. However, the invention of this application has broader application and could be used in other industries and for other cables, wires and/or conduits wherein it should not be limited to the disclosed use.

INCORPORATION BY REFERENCE

The present invention relates to conduits used for electrical wiring and, more particularly, for cables used for electrical wiring and the unwinding of the spools of these cable that are purchased for the building and/or construction industry. Coleman et al U.S. Pat. No. 5,189,719 discloses a rectangular flexible armored cable; Falciglia et al RE38,345 discloses a round flexible armored cable; and Dollins et al. U.S. Pat. No. 6,825,418 discloses a coded flexible armored cable. These patents are incorporated by reference herein as background information illustrating flexible armored cables including MC style cables and form part of this specification. Temblador U.S. Pat. No. 6,486,395 discloses a flexible armored cable with a special wiring configuration to illustrate that the invention of this application can be used in connection with all flexible armored cable, regardless of the wire gauge and/or wire configuration in the flexible armored cable, and is also incorporated by reference herein as background information and forms part of this specification. This application also incorporates by reference U.S. patent application Ser. No. 12/572,283 filed on Oct. 2, 2009 which is a continuation of U.S. application Ser. No. 12/069,780, filed Feb. 13, 2008 (now U.S. Pat. No. 7,608,782 issuing on Oct. 27, 2009), which application is a continuation-in-part of U.S. patent application Ser. No. 11/450,119 filed on Jun. 9, 2006 (now U.S. Pat. No. 7,456,361 issuing on Nov. 25, 2008) which application claims priority in U.S. provisional application Ser. No. 60/688,954, filed Jun. 9, 2005, entitled "CLIP" and U.S. provisional application Ser. No. 60/759,715, filed Jan. 18, 2006, all of which are incorporated by reference herein and form part of this specification.

BACKGROUND OF THE INVENTION

The invention of this application relates to a cable dispensing system and, more particularly, to a cable dispensing system that can be used to dispense cable from a purchased spool of cable that does not have a central core and do so without low resistance and without kinking. Dispensers of wire and cable have been used for many years and some of these systems have been successful for certain applications. But, there are no systems that can effectively control the unwinding of a spool of cable that when the spool is not wound around a central core. In this respect, some cables, such as MC Cable, are sold in spools that have no central core. Instead, the wire or cable is merely wound about itself by wrapping the cable about a central axis such that the wound cable generally forms an annular mass of cable. The spool of cable is then secured by binding the annular mass with straps to prevent it from unwinding. While this is a low cost method of selling cable, this kind of cable is difficult to handle and to unwind without tangles. This is especially true since the wire spool tends to spring outwardly from the cable axis when the straps are removed.

Some prior art systems have attempted to control the unwinding of these kinds of cable spools, but these systems have been found to be commercially and functionally ineffective. In general, these systems utilize a central rotational axil to support a spool of cable. However, these spools do not include a central core wherein central axil type systems have been found to be ineffective.

To show the need and advantages of the present invention, a prior system that incorporates a central axil noted above, will be hereinafter explained in detail. This disclosure merely constitutes background material. The prior system is the Wire Tub by RACK-A-TIERS®. The Wire tub utilizes a rotating base plate positioned within a tub and which is joined relative to the tub by a central axil. The base plate further includes a central "hub" that rotate together about the central axil, a bolt, that is configured to control the rotation of the base plate. The system further includes one or more spacer washers positioned between the base plate and the tub bottom that space the base plate from the tub bottom and allow the base plate and the central hub to rotate together about the central bolt within the tub. While the system provides rotating action within the tub that can be used to unwind the cable from the spool out of a hole in the tub, it has been found that the cable can kink as it is unwound and the cable can be difficult to pull from the dispenser.

In greater detail, the Wire Tub utilizes a base plate and central hub that are supported by the spacer washers surrounding and the central bolt and the remaining portions of the rotating base plate are intended to float above the tub bottom. Thus, spacer washers provide the rotational movement and support the weight of the spool for the based plate and the central bolt maintains a desired alignment. As can be appreciated, the use of washers for the rotational support produces rotational drag for the rotation of the base plate about the bolt. Further, the center of gravity of the wire spool must be centered within the tub or the base plate can tilt relative to the central bolt and can engage the tub. Once this occurs, pulling resistance increases even more and can be significant when the base plate drags against the tub. However, the center of gravity of these kinds of spools is not defined since these spools have no central core. As a result, the center of gravity is often out of alignment with the central axis of the wire spool and this will result in the base plate tilt and base plate drag. The Wire Tub attempts to account for the base tilt by utilizing multiple washers between the base plate and the tub base to increase the spacing therebetween. However, if the center of gravity is spaced far enough from the central washers, base plate tilt and drag will occur. In view of the weight of these spools (can be over 20 pounds), the amount of misalignment of the center of gravity does not need to be significant to cause base plate drag. Further, the center of gravity of the spool will shift as the wire is unwound from the spool since there is no central core and since these kinds of cables spring outwardly when the cable straps are removed. As is known in the art, this outward springing is not uniform, which can worsen this shifting center of gravity and the base plate tilt/drag.

The Wire Tub also attempts to overcome the shifting center of gravity of the spool by utilizing a central structure that is referred to as a "hub." The hub is configured to engage the inner annular surface of the wire spool in an attempt to mimic a central spool core. This central hub is therefore fixed relative to the rotating base plate so that the "hub" rotates with the spool of wire and can frictionally engage the inner annular surface of the wire spool. Further, the central hub must be adjustable so that the hub can engage the inner annular surface of a wide range of spools and spool sizes in an attempt to simulate a wire spool that is wrapped about a central spool core (like a spool of thread). This adjustment feature comes in the form of three adjustable hub slats that are sheet like and extend radially from the central axis to effectively change the overall diameter of the hub so that the hub can positively engage the inner annular surface of wire spool having different inner diameters. However, the use of the central hub to control the center of gravity has been found to cause kinking in the cable as it is unwound from the spool by not allowing free floating movement of the cable within the tub. Therefore, there is a need in the industry for a spool dispenser that (a) can work with cables, such as MC Cables, that are not wound about a central core and (b) is commercially and functionally effective. The invention of this application has satisfied this need.

SUMMARY OF INVENTION

The invention of this application relates to a cable dispensing system and, more particularly, to a cable dispensing system that can be used to smoothly dispense cable from a purchased spool of cable having no central core without kinking or tangling.

More particularly, the invention of this application relates to a cable dispensing system for unwinding a cable from a spool of cable and more particularly for a purchased spool of cable without a central core. The system includes a tub having a base and at least one side wall extending upwardly from the base to an upper edge, the tub further includes an opening in the at least one side wall and an inner space sized to fit a spool of cable. The system has an inner assembly with a base plate and a bearing assembly positioned between the plate and the tub base. The bearing assembly allowing the free rotation of the plate relative to the tub base about an inner space or system axis and isolating the base plate from the tub thereby allowing the associated spool to rotate about the inner space axis. The bearing assembly achieves this by being positioned away from the central system axis thereby supporting the weight of the cable without base plate tilt. The opening in the at least one side wall being configured to allow passage of the cable out of the inner space wherein pulling the cable out of the inner space rotates the spool about the inner space axis and prevents kinking.

According to yet another aspect of the present invention, the dispenser further includes a central column that is rotatably joined to the base plate that can rotate relative to the base plate to further reduce friction in the dispenser.

According to a further aspect of the present invention, the column transforms the inner space of the dispenser into an annular inner space and the bearing assembly includes rolling members that are general centered in the annular space.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DESCRIPTION OF PREFERRED EMBODIMENTS

Figure 1:
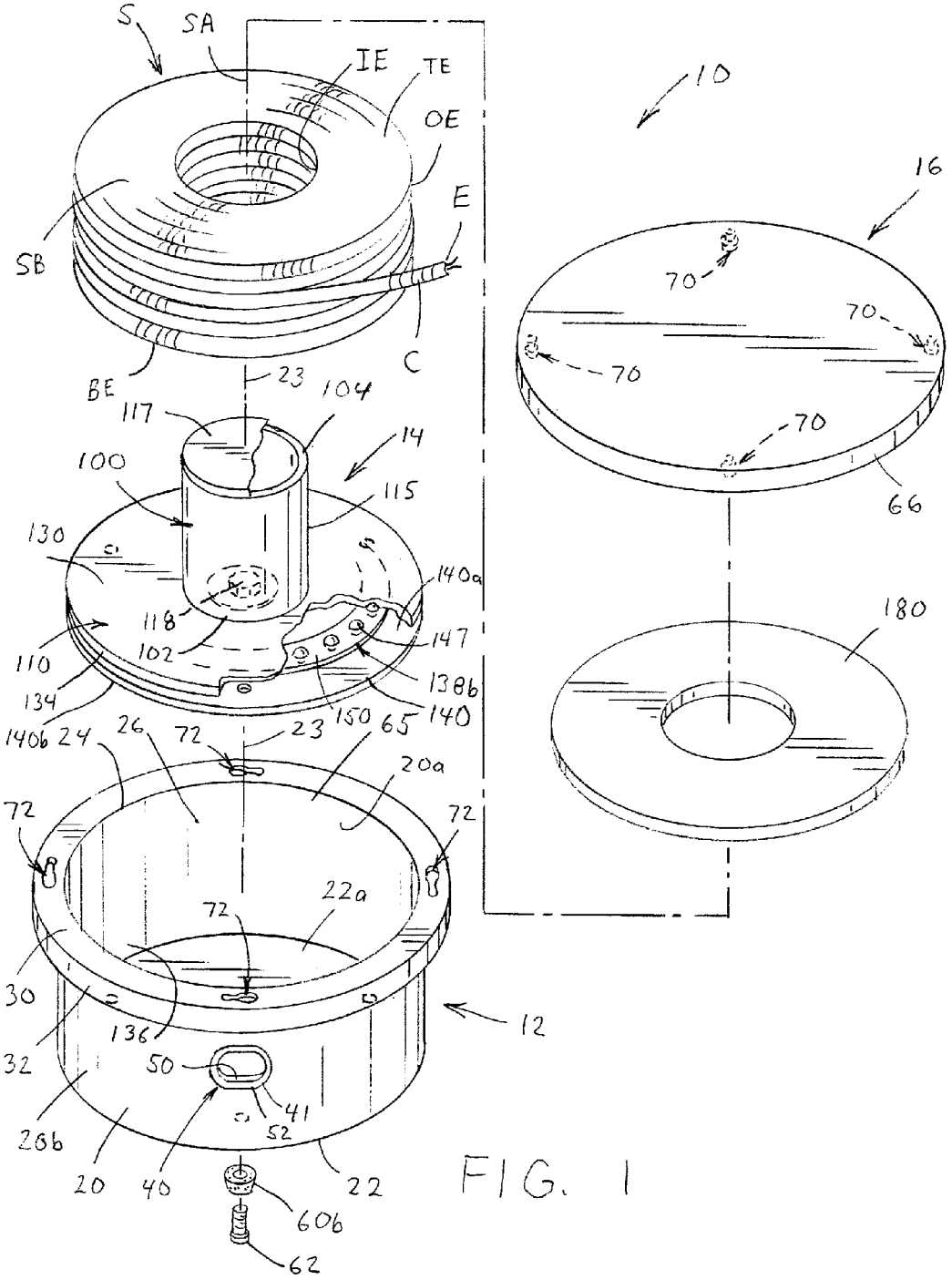
FIG. 1 is an exploded perspective view of a dispenser according to certain aspects of the invention of this application along with a purchased spool of cable.
Figure 2:
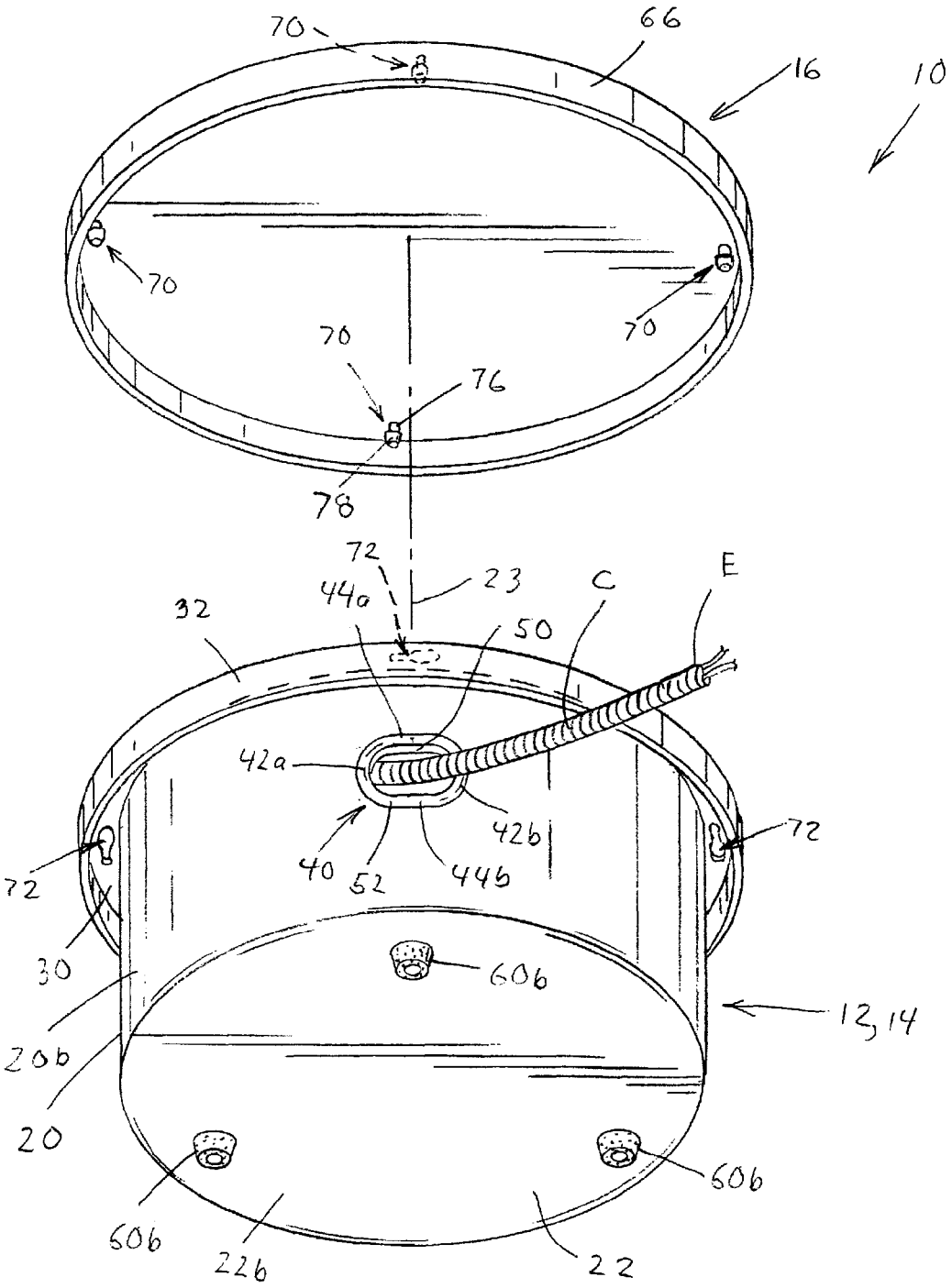
FIG. 2 is a bottom perspective view of the dispenser shown in FIG. 1.

Referring now to the drawings wherein the showings are for the purpose of illustrating preferred and alternative embodiments of the invention only and not for the purpose of limiting the same, FIGS. 1-12 show several embodiments of a cable dispenser 10 for dispensing a wide range of cables C from a wide range of spools S. In particular, the invention is directed to wire spools that do not have a central core and has been found to work extremely well in connection with MC Cable and will therefore be described with relation to MC Cable even though it has broader application. In that spool S has no central core, spool S has a generally annular configuration with an annular spool body SB that generally extends about a spool axis SA between an inner annular surface or extent IE and an outer annular surface or extent OE. Annular spool body SB further generally extends between a top extent TE and an oppositely facing bottom extent BE. As can be appreciated, and which is discussed in greater detail in this application, these kinds of spools tend to spring outwardly (both radially and axially) wherein these extents are often not well defined and can constantly change. However, as will be discussed more below, the invention of this application maintains a general annular configuration, which will be referenced below, that allows for the smooth and tangle free unwinding of the cable from the spool that has not been realized before.

More particularly, dispenser 10 includes a tub or tub assembly 12, an inner tub assembly 14 and can include a lid 16. Tub 12 can be produced by a wide range of manufacturing techniques and can be formed from a wide range of materials. However, it is preferred that tub 12 and other components of dispenser 10 be formed by durable material (s) in that dispenser 10 is for use at a jobsite. The materials for producing the tub (and other components) include, but are not limited to, PVC, ABS, polypropylene, steel, aluminum, glass filled polymers and/or composites. In a preferred embodiment, tub 12 is formed from a glass filled polycarbonate.

Tub 12 includes at least one side wall 20 that extends from a tub base 22 to an upper side wall edge 24. Side wall 20 has an inner surface 20*a* and an outer surface 20*b*. Side wall extends about a system axis 23, which will be discussed more below. In a preferred embodiment, side wall 20 is a single side wall having a generally cylindrical configuration. Further, this cylindrical wall configuration can include one or more tapered sections wherein the tub wall can have a conical configuration(s). However, side wall 20 could be formed by multiple side walls (such as a polygonal configuration) and could be formed by multiple layers wherein inner and outer side surfaces 20*a* and 20*b*, respectively, could be part of separate components. As will be discussed more below, side wall 20, or in particular inner side wall surface 20*a*, partially defines an inner tub space 26 that is sized to fit a desired spool S of cable C. Similarly, tub base includes a tub base inner surface 22*a* and a tub base outer surface 22*b* wherein tub base inner surface 20*a* faces inner space 26 and the tub base outer surface 22*b* is configured to allow the system to rest on an associated support surface SS.

Tub 12 can further include a top edge flange 30 extending about upper side wall edge 24 and flange 30 can have a downwardly extending lip 32. Flange 30 and lip 32 can have more than one function. In this respect, lip 32 can reinforce flange 30 and both can produce an annular handle for the dispenser. Further, flange 30 and lip 32 help to reinforce the side wall(s) of the tub thereby forming a rigid tub structure. While not shown, tub 12 and/or lid 16 could also include one or more grab handles. As is known in the molding art, these handles could be molded into the respective components and/or adhered or fastened thereto.

Tub 12 further includes a cable opening 40 to allow for the dispensing of cable C, which will be discussed in greater detail below. In one embodiment, opening 40 can be positioned above or near top extent TE of spool S. In other embodiments, it can be positioned at or near outer extent OE. Opening 40 is sized to allow the free flow of cable C from within inner space 26. In one embodiment, opening 40 is an elongated opening including curved ends 42*a* and 42*b* spaced apart by top and bottom edges 44*a* and 44*b*, respectively. As a result, the elongated opening 40 has a cable opening width 46 parallel to the tub base and a cable opening height 48 extending between the tub bottom and the upper side wall edge, the cable opening width being greater than the cable opening height. This configuration has been found to allow cable C to be easily pulled from the inner space for use by workers at a jobsite.

In yet another embodiment, opening 40 can be formed by a separate component, namely, a cable opening insert 41 that can be made from a different material better adapted for the wear associated with the outflow of wire from this opening and/or for the smooth engagement with cable C. It has been found that nylon works well for this component in that it has both better wear characteristics and it provides a smooth cable engagement. Tub 12 and/or component 41 can have an opening edge 50 that is rounded to prevent damage to the cable and to further help the free flow of cable from the dispenser. In order to help increase the curve of edge 50, tub 12 and/or component 41 can include a thickened portion 52, which can also function to reinforce the opening and reduce the effects of wear on the system.

While tub base outer surface can be used to support dispenser 10 on support surface SS, tub 12 can further includes one or more feet 60 to better stabilize dispenser 10 on the desired support surface. As is shown, it is preferred that three feet be utilized to support the system on support surface SS since three feet work to self adjust the system on uneven surfaces. This can be important since a support surface can be any surface including, but not limited to, a floor surface, a table surface, a shelf surface and/or a ground surface. Yet further, feet 60 can have multiple functions including improving the stability of dispenser 10 on the surface such that the dispenser does not rock or wobble during use and to provide a controlled wear point to allow for the sliding of the device around on the floor. In one set of embodiments, tub base 22 includes a thickened and/or raised portions 60*a* to provide the controlled wear point (see FIG. 12). As in known in the art, cable spools can be heavy wherein it may be easier to slide device 10 from one location to the next over picking up the device with the cable inside for movement.

Figure 3:
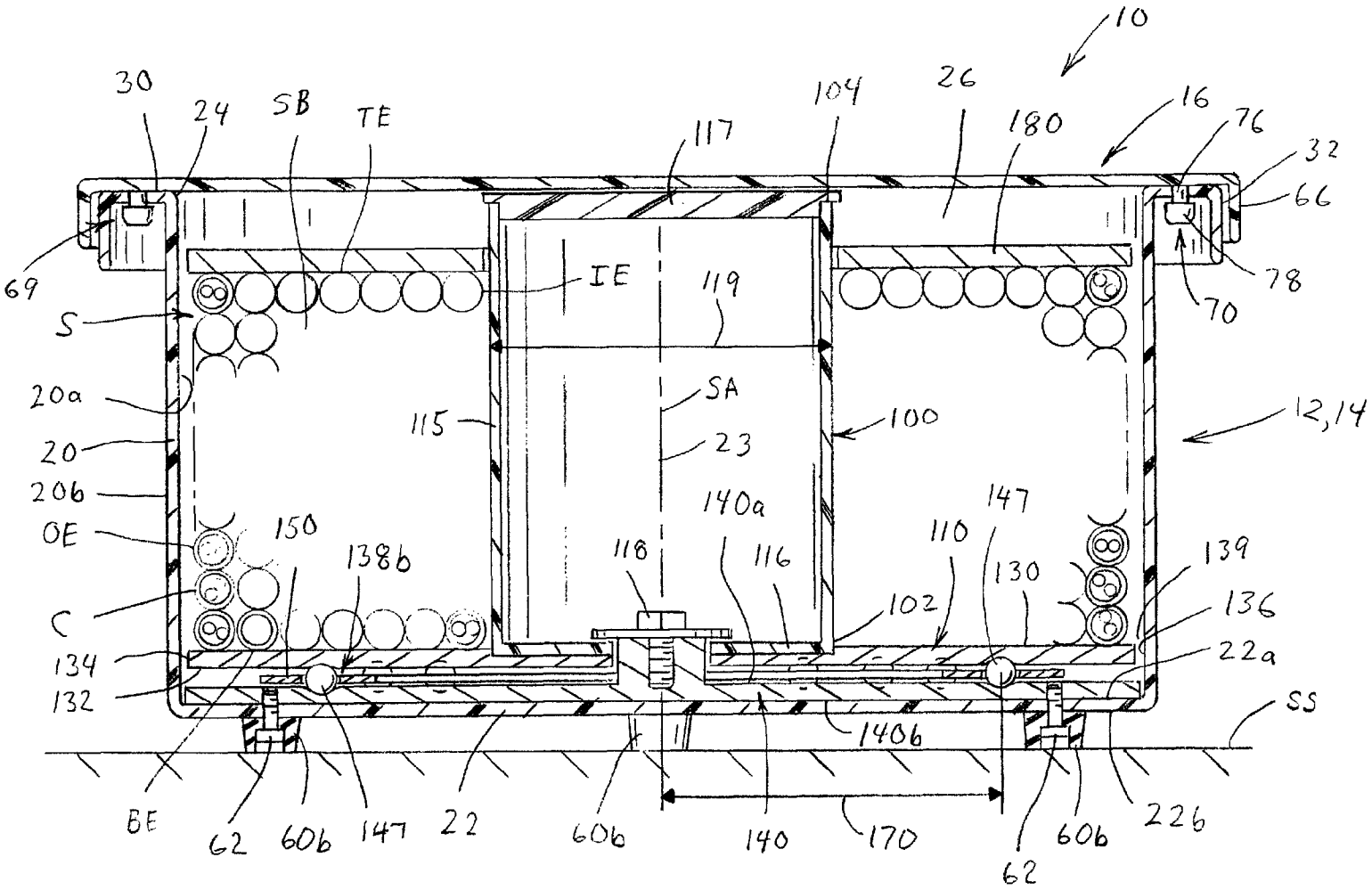
FIG. 3 is a sectional view of the dispenser shown in FIG. 1.
Figure 4:
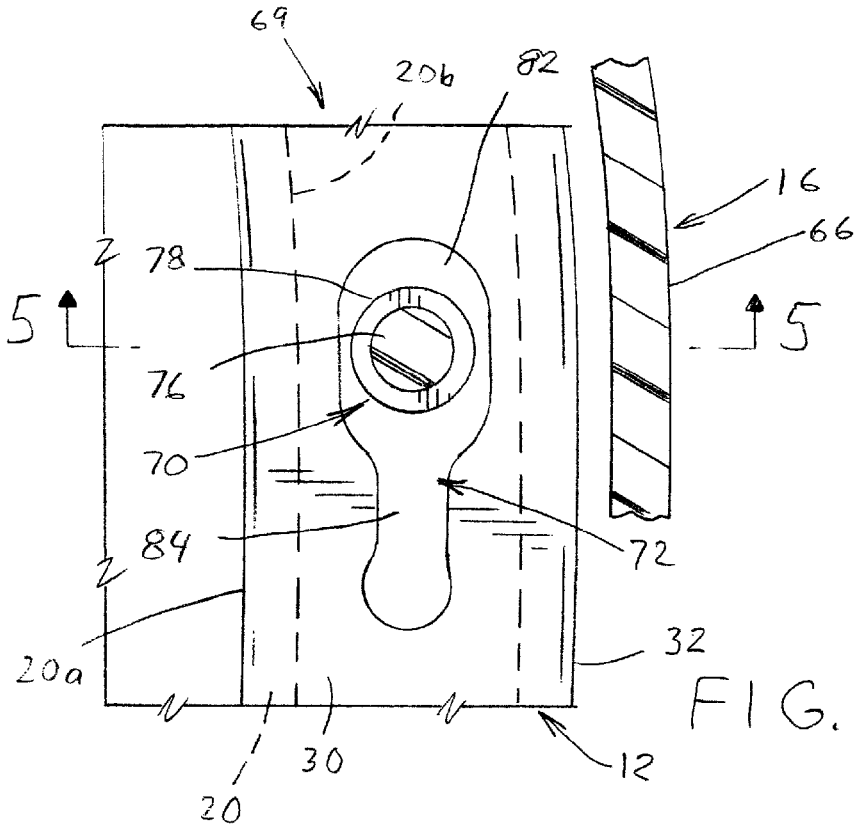
FIG. 4 is an enlarged bottom view of a locking feature for a lid and which is shown in an unlocked condition.
Figure 5:
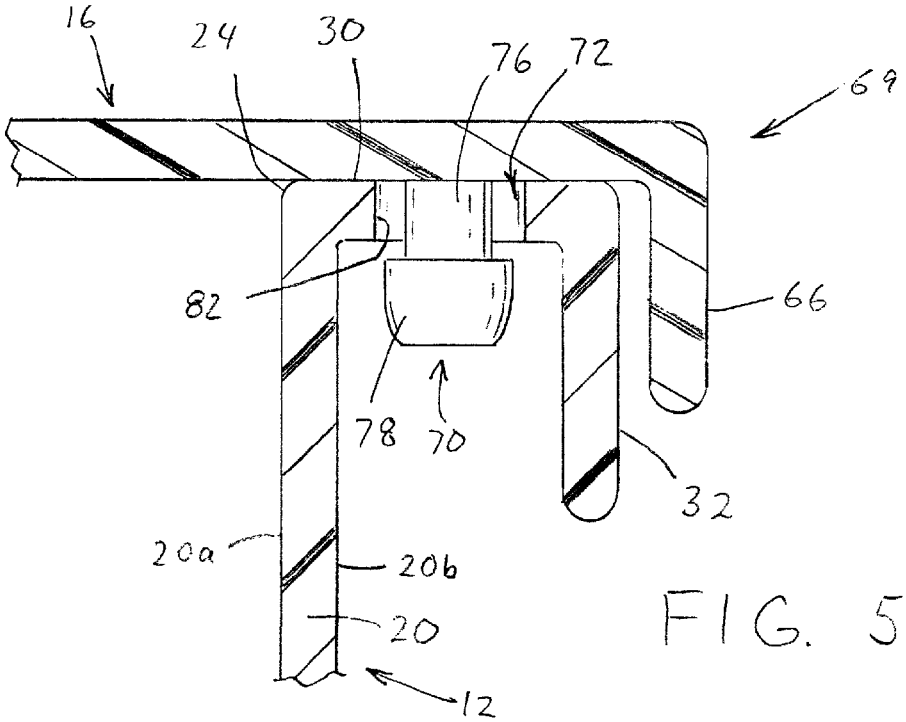
FIG. 5 is a sectional view taken along line 5-5 in FIG. 4.
Figure 6:
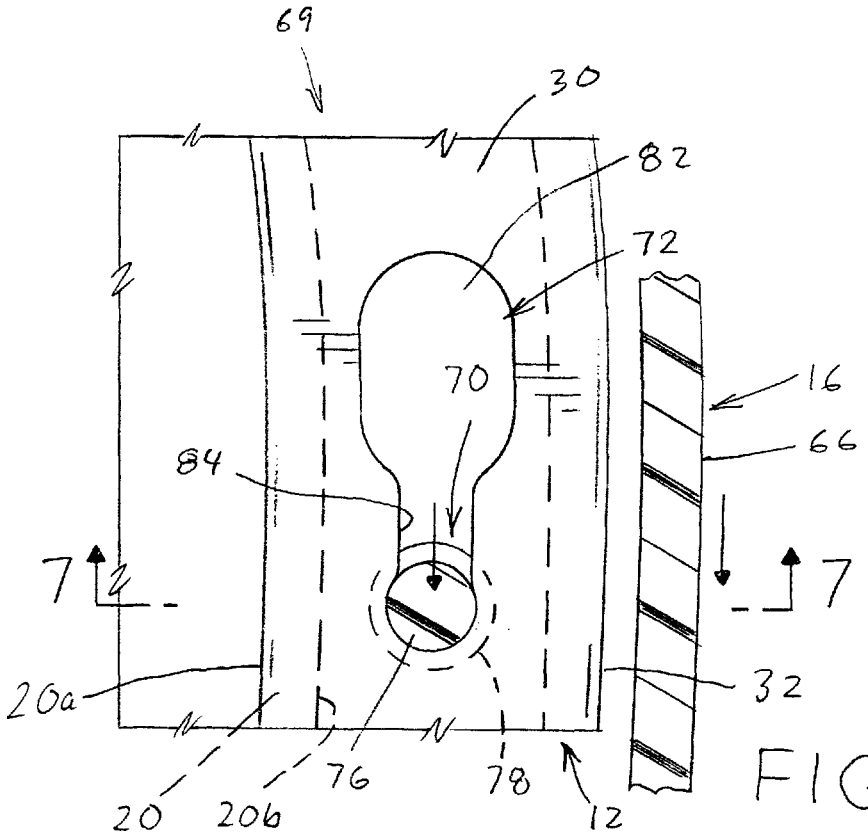
FIG. 6 is an enlarged bottom view of the locking feature shown in FIG. 4 for the lid and which is shown in a locked condition side elevational view of the tub shown in FIG. 5.
Figure 7:
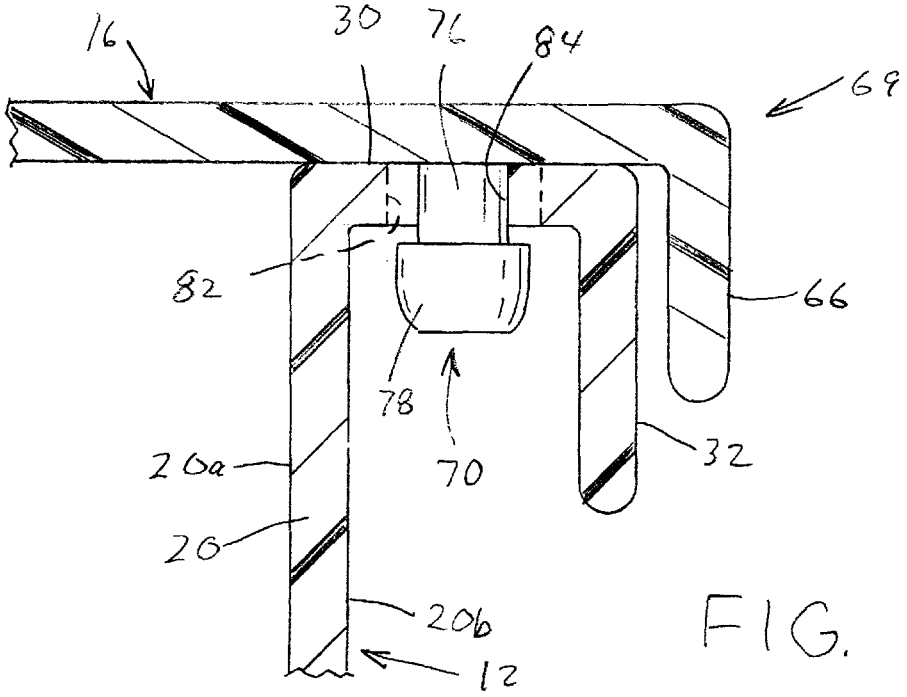
FIG. 7 is a sectional view taken along line 7-7 in FIG. 6.
Figure 8:
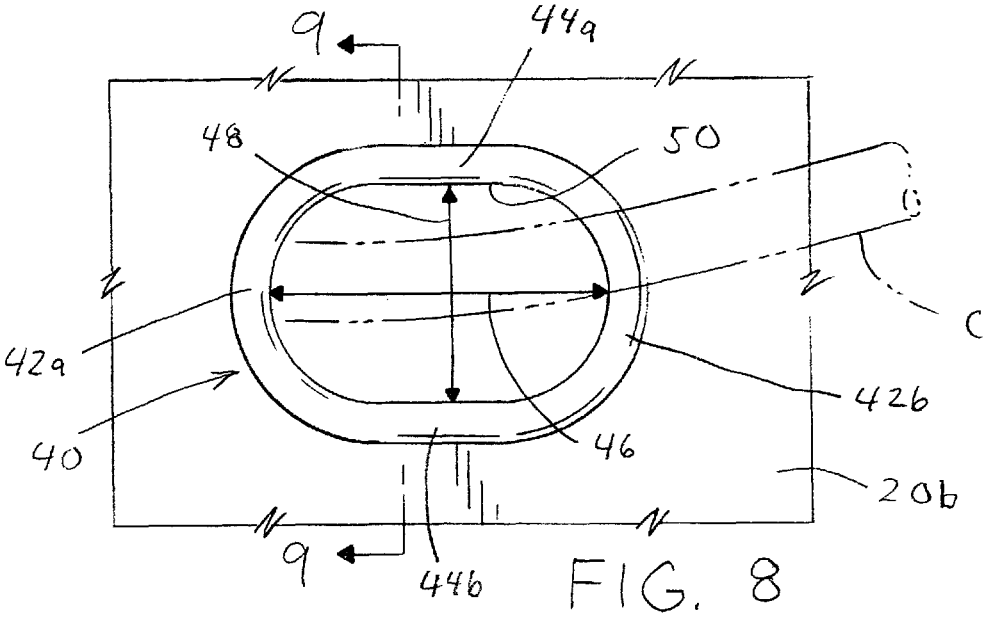
FIG. 8 is an enlarged side view of a cable opening shown in FIG. 1.
Figure 9:
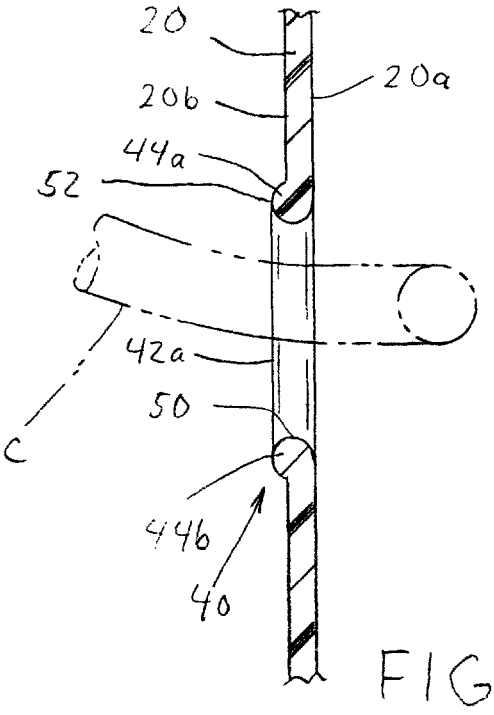
FIG. 9 is a sectional view taken along line 9-9 in FIG. 8.
Figure 10:
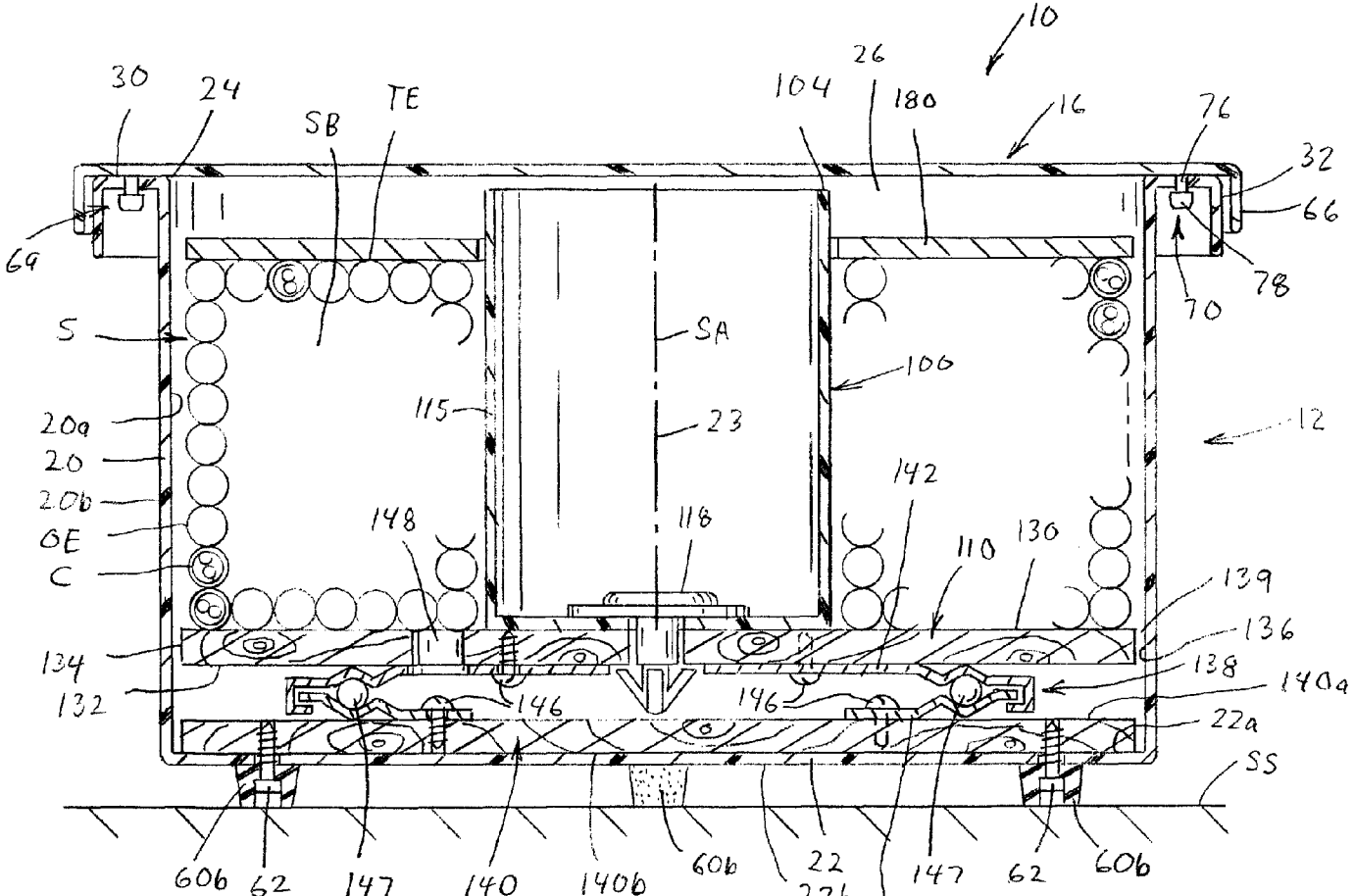
FIG. 10 is a sectional view of another set of embodiments of the invention of this application that include a different bearing assembly and base plate arrangement.

In yet other embodiments, feet 60*b* can be separate components that are secured relative to tub base 22 (See FIGS. 3&10). This configuration can be utilized to create additional functions to those noted above including allowing for the use of specialized materials that have either better wear characteristics and/or increased frictional contact to prevent unwanted movement of the dispenser as the cable is being pulled from the dispenser. Further, the fasteners can be used to secure portions of the inner assembly 14 relative to the tub. The specialized materials can be any materials known in the art and include, but are not limited to, rubber and/or polymer feet. The feet can be adhered to base 22, fastened to base 22, and/or molded into base 22. These non-skid feet can be configured to prevent unwanted movement of the dispenser when the cable is being pulled form the system and can be configured to provide a thickened wear points, and can still allow selective sliding of the system across the floor surface. In one set of embodiments, feet 60*b* are round feet formed from a rubber or polymer components that are fastened to the tub base by fasteners 62. Again, these fasteners can also be used to secure portions of inner assembly 14 relative to tub base 22.

Lid 16 can have a wide range of configurations and/or functions. These can include shapes and/or panels that allow for the placement of product labels, configurations such as ribs to improve strength and the lid can shield the inner space from dirt. Further, these features can include one or more latching features and even a handle. In this respect, lid 16 can include a downwardly extending flange 66 to help strengthen lid 16, align the lid relative to the tub and to help seal off inner tub space 26. As is known in this art, jobsites can often be dirty and dusty wherein closing off a spool receiving opening 65 of tub 12 can reduce the dirt and/or debris that enter inner tub space 26. Lid 16 can be produced from a wide range of materials including, but not limited to PVC, ABS, polypropylene, steel, aluminum and glass filled polymers and/or composites. As with tub 12, lid can be made from a glass filled polycarbonate.

In yet another set of embodiments, lid 16 can be configured to selectively lockingly interengage with tub 12. In the embodiments shown, this can include a locking feature 69 that can be any locking arrangement known in the art. As is shown, feature 69 includes four sets of locking barbs 70 extending from lid 16 and corresponding locking slots 72 in flange 30. Locking barbs 70 can include a stem portion 76 and a barb portion 78. The corresponding locking slots 72 can include a passage opening 82 and a narrow slot 84 wherein passage opening is sized to allow the passage of barb portion 78 and slot 84 is sized smaller than barb portion 78, but larger than stem 76. As a result, locking barbs 70 can enter slots 72 and rotation of lid 16 relative to tub 12 can urge stem 76 into slot 84 and lock the lid relative to the tub. This can be used to close off inner tub space 26 once the cable is loaded into dispenser 10 and the free end of the cable is directed out of opening 40. The locking arrangement can also include a resistance fit between stem 76 and slot 84 to maintain the lid in the closed condition.

Inner assembly 14 is sized to fit within inner space 26 and to provide selective rotational movement for the dispenser to allow cable C of spool S to freely rotate relative to tub 12 about system axis 23. This movement of the cable and/or spool allows for low resistance removal of the cable from inner space 26 without, kinking, tangling or twisting of the cable. More particularly, assembly 14 can include a central column 100 having a base edge 102 and a top edge 104. Central column can transform inner space 26 into an annular inner space and improve the unwinding of the cable from the spool without tangling by further reducing tangling and reducing pulling resistance, which will be discussed in greater detail below. Inner assembly 14 includes a base plate 110 that is rotatable relative to tub 12 about axis 23 and which provides both even support and control of spool S, which also will be described in more detail below. Further, column 100 can be secured relative to base plate 110 such that column 100 and plate 110 move together, but in a preferred set of embodiments, column is configured to move relative to plate 110 which as been found to further control the unwinding of the cable and reduce cable binding. In addition, it is preferred that the top plate is generally rigid and configured to evenly support the weight of cable spool S about assembly or system axis 23. Base plate 110 can be made from a wide range of materials including, but not limited to, wood, press board, plastic, polymers, steel, metal alloys and/or material blends. Further, base plate 110 can include structural reinforcements, such as ribs, to increase rigidity. Column 100 can be made from a wide range of materials and can be a hollow tube or sleeve. It is preferred that column is made from a PVC plastic and is constructed from a single side wall 115. Column 100 can further include a bottom 116 and the bottom can help secure column 100 relative to base plate 110 and/or provide a desired amount of relative rotation between the column and base plate to reduce internal friction during the unwinding of the cable spool and to allow the cable spool to self adjust as it is being removed from the dispenser. Column 100 can further include a column cap 117 that can seal off the internal portions of the component when a sleeve like configuration is used. Column 100, and in particular side wall 115, can be cylindrical and wall 115 has a diameter 119 depending on the size of the dispenser and the cable to be unwound. In one embodiment, diameter 119 is greater than 4 inches. In a preferred embodiment, diameter 119 is approximately 6 inches. In one embodiment, a fastener 118 can be used to secure column 100 to base plate 110. Further, fastener 118 can be a single fastener that allows for the relative rotation between column 110 and base plate 110. While a threaded fastener is shown, fastener 118 can be any fastener known in the joining arts including snap fit fasteners to reduce production times and costs as is shown in FIGS. 10 and 12.

In greater detail, base plate 110 has a top surface or side 130 and an oppositely facing bottom surface or side 132. Base plate 110 further includes a peripheral edge 134. Top side or surface 130 further defines inner space 26 and bottom side 132 faces tub base 22. Base plate 110 is selectively rotatable relative to the tub about system axis 23 and this rotation could be controlled by the engagement between peripheral edge 134 and a guide surface 136 formed in inner wall surface 20*a*, but as will be discussed more below, it is preferred that the base plate rotates freely within the inner space to reduce internal friction. Guide surface 136 can come in many forms including, but not limited to, a specially configured surface portion in wall surface 20*a*, part of a separate component joined to surface 20*a* and/or merely a contiguous surface portion that is part of surface 20*a*. As a result of this configuration, tub 12 can be a simple molded item that does not need a central bearing and/or axil support for the rotation of base plate 110 as is shown in FIGS. 3 and 10).

Inner assembly 14 further includes a bearing assembly 138 between the base plate and the tub base inner surface 22*a*. The bearing assembly supports the base plate and allows the free rotation of the base plate relative to tub 12 about system axis 23. In the embodiments discussed above, the rotation of base plate can partially controlled by peripheral edge 134 and guide surface 136, but it is preferred that base plate 110 be spaced from the tub, which will be discussed more below. By including a bearing assembly that is between the base plate and the tub bottom, the inner assembly is allowed to freely rotate and the base plate is evenly supporting by the bearing assembly wherein inner assembly can easily support the weight of cable or spool S without tilt or drag thereby allowing for free rotation about axis 23.

Figure 12:
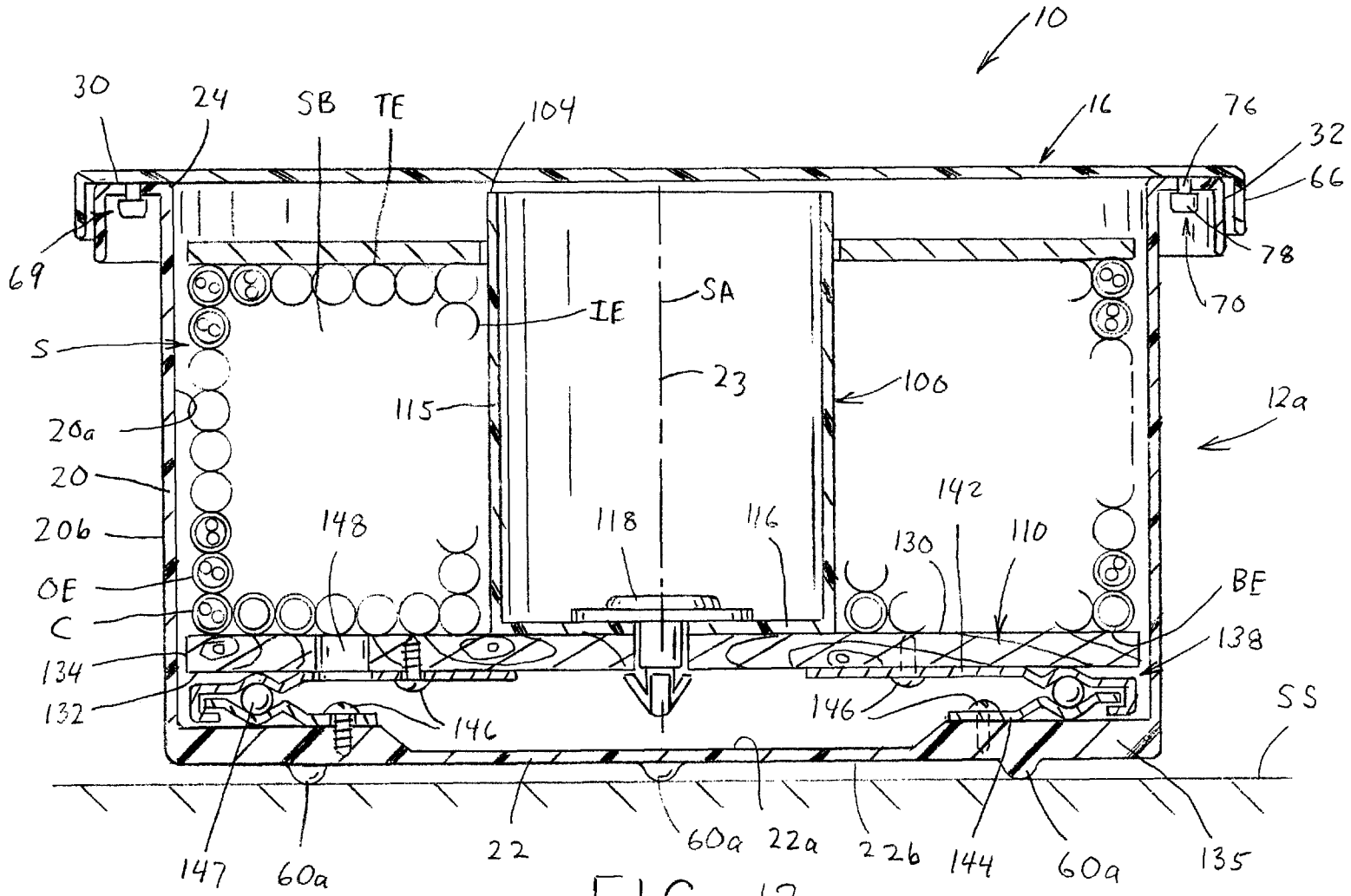

As is noted above, a preferred set of embodiments enhances the free rotation of the based plate by isolating base plate 110 from the tub, which is shown in FIGS. 3, 10 and 12. In this respect, base plate 110 can be sized to produce a gap or spacing 139 between peripheral edge and inner side wall 20*a* wherein the bearing itself controls the rotation of the base plate and the base plate is fully spaced from (or does not touch) the tub. This in combination with bearing assembly that prevents tilt has been found to virtually eliminate rotation resistance and internal friction, which makes the unwinding of the cable virtually effortless and without kinking or tangling. Further, as with the embodiments discussed above, this allows tub 12 to be a simple molded item that does not need a central bearing and/or axil support for the rotation of base plate 110.

Figure 11:
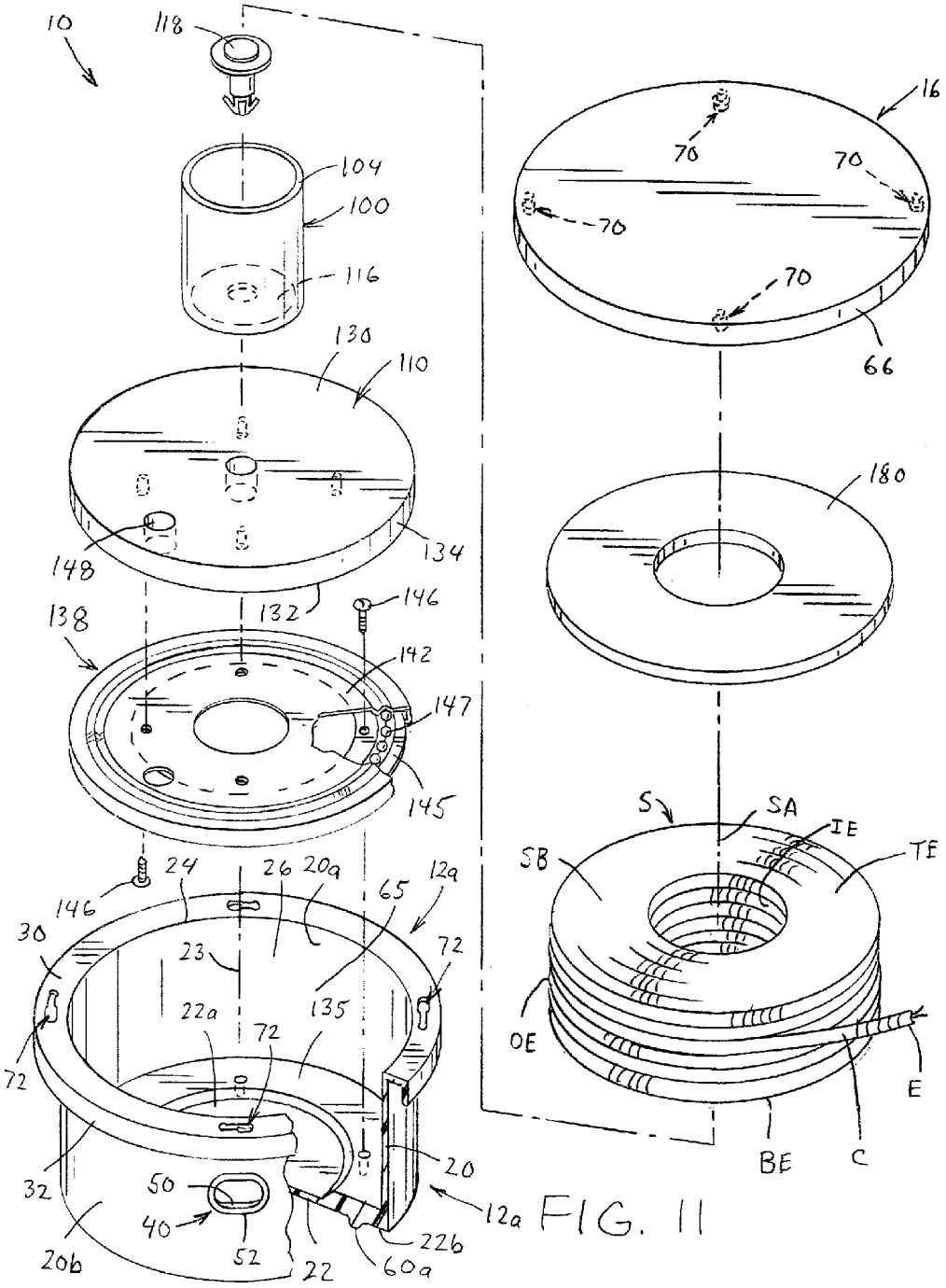
FIG. 11 is an exploded perspective view showing yet another set of embodiments of the invention of this application that do not include a bottom base plate and with molded feet; and, FIG. 12 is a sectional view taken from FIG. 11.

The embodiment shown in FIGS. 11 and 12 best shows the set of embodiments that includes a single base plate 110. For these embodiments, tub 12*a* can include a mounting arrangement 135 that can be utilized to secure bearing assembly 138 relative to tub 12*a*. As is shown, mounting arrangement can include an annular section having a greater cross-sectional thickness to allow the bearing assembly to attach directly thereto.

In further embodiments, such as those shown in FIGS. 3 and 10, inner assembly 14 can include a second base plate. In this respect, base plate 110 can be a top base plate and inner assembly can further include a bottom base plate 140 having a top side or surface 140*a* and an oppositely facing bottom side or surface 140*b*. Bottom surface 140*b* can rest directly on base 22 of tub 12 and bottom plate 140 can be fixed relative to tub bottom 22. Bottom plate 110 also can be made from a wide range of materials including, but not limited to, wood, press board, plastic, polymers, steel, metal alloys and/or material blends. In this embodiment, bearing assembly 138 is positioned between top surface 140*a* of bottom base plate 140 and bottom surface 132 of top base plate and separates the top plate from the bottom plate and allows free relative rotation between the plates. In that bottom plate is fixed relative to tub 12, top base plate 110 moves relative to both bottom base plate 14 and tub 12. This arrangement can increase the rigidity of the tub, add additional weight to the tub to prevent inadvertent lifting or tilting of the tub from surface SS and improve the longevity of the dispenser. Further, this arrangement can be used with any of the embodiments of this application.

Bearing assembly 138 is configured to even support the weight of the spool and prevent unwanted tilting, dragging and/or strain as the center of gravity of the spool shifts. This has been found to drastically improve the dispensing movement of dispenser 10, prevent kinking and results in the free movement of wire exiting opening 40. More particular, bearing assembly 138 can be any bearing assembly known in the art that can be positioned between base plate 110 and tub bottom 22, support a load that is parallel to axis 23 and control the rotation of the top base plate. This includes, but is not limited to, annular bearing assemblies, ball bearing arrangements, roller bearing arrangements and/or thrust bearings. In a preferred set of embodiments, the bearing is spaced from axis 23 such that it is located below annular spool body SB of cable C. Thus, the base plate is free to rotate about axis 23 relative to tub base 22 without tilt or drag thereby allowing base plate 110 and spool S to freely rotate relative to both the bottom plate and the tub. Further, by including the use of a thrust style bearing, the bearing assembly evenly supports the weight of the spool body, controls rotation and provides friction free rotation of the base plate about axis 23. In one set of embodiments (FIGS. 10 and 12), bearing assembly 138 includes an upper bearing plate 142 that can be fixed relative to base plate 110 with fasteners 146 and a lower bearing plate 144 that can be fixed relative to tub bottom 22 and/or bottom base plate 140 with fasteners 146. Base plate 110 and/or base plate 140 can include bearing openings 148 to allow the bearing assembly to be secured to both plates and/or plate 110 and tub base 22. Bearing assembly further includes a plurality of rolling members 147 positioned between upper and lower bearing plates 142 and 144, respectively. However, as can be appreciated, the bearing plates could be replaced with bearing grooves and/or channels molded directly into base plate 110, 140 and tub bottom 22 thereby eliminated the bearing plates, as is shown in FIG. 3 as bearing assembly 138*b*, and bearing assembly 138*b* could include a roller member alignment plate 150. The bearing plate(s) are then fixed relative to the base plates and/or tub bottom such that the bearing assembly is self aligning and creates and maintains the alignment between base plate 110 and tub 12 and/or bottom plate 140 thereby allowing the base plate to be fully isolated from tub 12, which allows the base to rotate about axis 23 without resistance. Further, this again allows tub 12 to be formed from a simple molded item that does not need a central bearing and/or axil structure.

Further, it has been found that the location of rolling members 147 of bearing assembly 138 impacts the performance of the system and the support of the weight of the cable. In this respect, since the bearing arrangement of the dispenser of this application is configured to support both the rotational and axial loads, it is preferred that the bearing assembly includes rolling members 147 that are spaced from axis 23 by a bearing spacing 170 wherein rolling members have at least one defined diameter that spaces the rolling members from axis 23 by bearing spacing 170 and under the weight of the cable spool. In one embodiment, the bearing spacing is at least three inches. In another embodiment, the bearing spacing is at least five inches and in yet another, the bearing spacing is at least seven inches. However, as can be appreciated, these bearing spacings will depend on the size of the tub. In an embodiment wherein the tub is generally 12 inches high and 19 inches in diameter at the top extent, the tub base is approximately 17 inches in diameter. For this size tub, top plate can be 15.5 inches to space it from tub wall 20 and bearing spacing 170 is about 5.5 inches wherein the rolling members have a diameter coaxial with axis 23 of about eleven inches. In this embodiment, bottom base plate 140 can have a slightly larger diameter of about 16.5 inches to better match the diameter of tub base 22. Yet further, and as is shown in FIG. 12, the bearing spacing can position rolling members such that they are near the outer extent of the inner space. In a preferred set of embodiments, regardless of the size, rolling members 147 are generally between tube wall 115 and side wall 20, as is shown in FIGS. 3 and 10; namely within the annular inner space 26. In a preferred set of embodiments, rolling members are centered in this annular space. This produces even support of the spool in the inner space, prevents base plate tilt and/or drag wherein it has been found that internal friction is virtually eliminated regardless of the shifting center of gravity of spool S. Rolling members 147 as are noted in this application can be any bearing structure that provides the low resistance movement between two structures and generally refer to the portion of the assembly that provides this low resistance movement; this can include, but is not limited to, a plurality of ball bearings and/or a plurality of rollers bearings spaced about axis 23 by the bearing spacing.

In yet another set of embodiments, dispenser 10 can further include an upper ring 180 that is selectively positionable above the spool after the spool is placed in inner space 26 and the cable end is directed out of opening 40. Upper ring 180 can help control the upward springing of spool S in operation by providing a hold down force. Upper ring 180 can be formed of materials similar to base plates 110 and/or 140, but can have different dimensions in view of the different diameter of tub 12 near the upper edge and different weights needed for the function of this ring. It has been found that this ring can be thinner and/or lighter than base plates 110 and/or 140 to help maintain a lower center of gravity to reduce tipping. In a preferred embodiment, upper ring 180 is a free floating ring within the inner space to help with the self alignment of the spool within the inner space to further reduce internal friction.

In operation, spool S is positioned in inner space 26 on the top of base plate 110 and about axis 23. For embodiments that include column 100, the spool extends generally annularly about axis 23 and column wall 115 and forms annular spool body SB. One of the ends E of cable C is then directed out of opening 40. Once end E is outside of the inner space 26, lid 16 can be positioned on tub 12 and fastener assemblies could be used to lock the lid to the tub. Then, the end user pulls on end E to unwind the cable from the spool. In that inner assembly 14 is allowed to freely rotate about axis 23 relative to tub 12 without tilt, the cable spool can freely rotate about axis 23 such that cable C can be removed from the dispenser without unwanted resistance, tangling and/or kinks. This allows a single user to unwind the cable from the spool and this can be done while on a ladder or scaffolding without the need for assistance by other workers or working the kinks out of the cable. Yet further, in embodiments that include column 100 that rotates relative to base plate 110, the portions of cable C of spool S that engage column 100 will not bind against the column in that the rotation of the column relative to the base will allow these portions of the cable to move around column toward opening 40 by rotating the column relative to the base plate thereby automatically adjusting the cable spool within inner space 26.

While considerable emphasis has been placed on the preferred embodiments of the invention illustrated and described herein, it will be appreciated that other embodiments and/or equivalents thereof can be made and that many changes can be made in the preferred embodiments without departing from the principals of the invention. Accordingly, it is to be distinctly understood that the foregoing descriptive matter is to be interpreted merely as illustrative of the invention and not as a limitation.

It is claimed:

1. A cable dispensing system for supporting a coiled spool of cable in coiled form without first unwinding the cable from the spool and for dispensing the cable directly from the coiled spool of cable with low resistance and without kinking, the system comprising a tub having a tub base and an upwardly facing spool receiving opening above the tub base, the upwardly facing spool receiving opening having an opening area parallel to the tub base, the tub further including at least one tub side wall extending upwardly from the tub base toward the upwardly facing spool receiving opening, the at least one tub side wall extending about a system axis and having an inwardly facing wall surface and an outwardly facing wall surface, the at least one tub side wall having a side wall cable opening spaced above the tub base and spaced below the upwardly facing spool receiving opening, the cable dispensing system further including an inner assembly, the inner assembly including a base plate that is selectively rotatable relative to the tub about the system axis, the base plate having a base plate bottom side and a base plate top side, the rotatable base plate further including a base plate peripheral edge facing the inwardly facing wall surface, the system further including a bearing assembly between the base plate bottom side and the tub base, the bearing assembly including rolling members and allowing the selective rotation of the base plate relative to the tub about the system axis, the inner assembly further including a central column having a column bottom extent and an opposite column top extent, the column bottom extent facing toward the tub base and the column top extent facing toward the upwardly facing spool receiving opening, the central column having a radially outwardly facing central column surface relative to the system axis that faces the inwardly facing wall surface, the radially outwardly facing central column surface having a cross-sectional column area transverse to the system axis, the radially outwardly facing central column surface and the inwardly facing wall surface forming an annular inner space extending between the base plate top side and the upwardly facing spool receiving opening, the annular inner space having an annular inner space area transverse to the system axis, the opening area of the upwardly facing spool receiving opening being at least as large as the annular inner space area to allow an associated coiled spool of cable to be lowered into the annular inner space in the coiled form, the associated coiled spool of cable having no central core wherein the associated coiled spool of cable has an annular spool body with a coiled spool top extent and an opposite coiled spool bottom extent, the associated annular spool body of the associated coiled spool of cable further including an inner annular spool extent that is coaxial with the associated spool axis that forms an associated central coiled spool opening having an associated spool opening area transverse to the spool axis, the associated annular spool body of the associated coiled spool of cable further including an outer annular spool extent that is coaxial with the associated spool axis, the outer annular spool extent and the inner annular spool extent of the associated coiled spool of cable defining an associated annular spool area transverse to the associated spool axis, the associated annular spool area of the associated coiled spool of cable being less than the annular inner space and the opening area of the upwardly facing spool receiving opening to allow the associated coiled spool of cable to be lowered into the inner space and allow the associated coiled spool bottom extent to rest on the base plate top side, and the cross-sectional column area of the central column being smaller than the associated spool opening area to allow the central column to enter the associated central coiled spool opening of the associated coiled spool of cable as the associated coiled spool of cable is lowered into the annular inner space, the selective rotation of the base plate relative to the tub allowing the associated coiled spool of cable to rotate about the system axis as the associated cable is pulled from the side wall cable opening; wherein the radially outwardly facing surface of the central column is rotatable relative to the base plate.

2. The cable dispensing system of claim 1, wherein the rolling members of the bearing are a plurality of rolling members spaced about the system axis by a bearing spacing and the bearing spacing being at least three inches from the central axis.

3. The cable dispensing system of claim 1, wherein the rolling members are a plurality of ball bearings.

4. The cable dispensing system of claim 1, wherein the bearing assembly is an annularly shaped bearing having a first bearing plate fixed relative to the base plate and a second bearing plate fixed relative to the tub base with a plurality of rolling members between the first and second bearing plates and guided by the first and second bearing plates, the roller members being spaced about the system axis by a bearing spacing and the bearing spacing being at least three inches from the central axis.

5. The cable dispensing system of claim 4, wherein the rolling members are centered under the associated annular spool body of the associated coiled spool of cable.

6. The cable dispensing system of claim 4, wherein the first and second bearing plates are secured relative to one another to retain the bearing assembly with the tub.

7. The cable dispensing system of claim 1, wherein the rolling members of the bearing assembly engage at least one of the base plate bottom side and the tub base inner surface.

8. The cable dispensing system of claim 1, wherein the side wall cable opening is an elongated opening having a side wall cable opening width parallel to the tub base and a side wall cable opening height extending between the tub bottom and the upper side wall edge, the side wall cable opening width being greater than the side wall cable opening height.

9. The cable dispensing system of claim 8, wherein the side wall cable opening has a rounded edge that has an edge thickness greater than a thickness of the at least one side wall of the tub.

10. The cable dispensing system of claim 1, wherein the rolling members are centered in the annular inner space.

11. The cable dispensing system of claim 1, wherein the central column is cylindrical and the base plate is disk shaped wherein the bottom extent of the central column engages the base plate top side and the central column is rotatable relative to both the at least one side wall and the base plate top side.

12. The cable dispensing system of claim 1, wherein the base plate is a top base plate and the system further includes a bottom base plate fixed relative to tub base, the rolling members of the bearing assembly being positioned between the top and bottom base plates.

13. The cable dispensing system of claim 12, wherein the rolling members being below the annular inner space.

14. The cable dispensing system of claim 13, wherein the central column is rotatable relative to both the at least one side wall and the base plate.

15. The cable dispensing system of claim 13, wherein the bearing assembly is an annularly shaped bearing having a first bearing plate fixed relative to the top base plate and a second bearing plate fixed relative to the bottom base plate base with a plurality of rolling members between the first and second bearing plates and guided by the first and second bearing plates, the roller members being spaced about the system axis by a bearing spacing and the bearing spacing being at least three inches from the central axis.

16. The cable dispensing system of claim 15, wherein the rolling members are centered under the associated annular spool body of the associated coiled spool of cable.

17. The cable dispensing system of claim 15, wherein the first and second bearing plates are secured relative to one another to retain the bearing assembly with the tub.

18. The cable dispensing system of claim 12, wherein the rolling members directly engage at least one of the top base plate and the bottom base plate.

19. The cable dispensing system of claim 1, further including an annular upper ring selectively positionable directly on the associated coiled spool top extent of the associated coiled spool of cable, the upper ring being a free floating ring within the annular inner space and providing a hold down force directed downwardly against the associated coiled spool of cable to help control the unwinding of the associated coiled spool of cable.

20. The cable dispensing system of claim 1, further including a lid, the lid being selectively positionable relative to the tub to selectively close the upwardly facing spool receiving opening.

21. The cable dispensing system of claim 20, wherein the lid includes a locking arrangement to lockingly secure the lid to the tub.

22. The cable dispensing system of claim 1, wherein the associated coiled spool of cable has an associated spool height between the associated coiled spool top extent and the associated spool bottom extent, the central column having a central column height between the column bottom extent and the column top extent, the central column height being greater than the associated spool height such that the central column passes completely through the associated central coiled spool opening when the associated coiled spool of cable is lowered into the annular inner space.

23. The cable dispensing system of claim 1, wherein the at least one tub side wall has a wall height between the tub base and the upwardly facing spool receiving opening, the central column height being approximately equal to the wall height.

* * * * *